US006113015A

United States Patent [19]

Brundiek

[11] Patent Number: 6,113,015

[45] Date of Patent: Sep. 5, 2000

[54] ROLLER MILL

[75] Inventor: Horst Brundiek, Kaarst, Germany

[73] Assignee: Loesche GmbH, Duesseldorf, Germany

[21] Appl. No.: 08/849,165

[22] PCT Filed: Nov. 3, 1995

[86] PCT No.: PCT/EP95/04327

§ 371 Date: Jul. 22, 1997

§ 102(e) Date: Jul. 22, 1997

[87] PCT Pub. No.: WO96/16742

PCT Pub. Date: Jun. 6, 1996

[30] Foreign Application Priority Data

Nov. 25, 1994 [DE] Germany ..... 44 42 099

[51] Int. Cl.[7] ..... B02C 15/00

[52] U.S. Cl. ..... 241/121

[58] Field of Search ..... 241/117–121

[56] References Cited

U.S. PATENT DOCUMENTS 4,611,765 9/1986 Shimojima et al. ..... 241/121

4,981,269 1/1991 Koga et al. ..... 241/119

FOREIGN PATENT DOCUMENTS 1507579 9/1970 Germany .

3921986 10/1990 Germany .

*Primary Examiner*—Mark Rosenbaum

*Attorney, Agent, or Firm*—Evenson, McKeown, Edwards & Lenahan, P.L.L.C.

[57] ABSTRACT

The invention relates to a roller mill with a rotary grinding bowl, grinding rollers rolling thereon and retaining devices for influencing the grinding material movement between the grinding rollers. For increasing the throughput of a low-cost roller mill, low-cost, effective retaining devices are provided between the grinding rollers and are in each case constructed as a rotary damming wall formed from one or more damming rolls. The damming rolls have damming faces, which block the outwardly moved grinding material and retain same for further grinding. In a first embodiment a damming face is constructed on the inner end face of a damming roll. According to a further development radially projecting damming rings with additional damming faces are fitted.

14 Claims, 2 Drawing Sheets

ROLLER MILL

FIELD OF THE INVENTION

The invention relates to a roller mill with a virtually horizontal grinding path on a rotary grinding bowl, having stationary grinding rollers, which roll on a grinding bed formed by the grinding material on the grinding path of the bowl, and with retaining devices, which are located between the grinding rollers for influencing the grinding material movement.

BACKGROUND OF THE INVENTION

In roller mills, which are also known as air-swept roller mills or roller bowl mills, a grinding material flow supplied to the centre of a grinding bowl and containing fresh material and coarse particles from a classifier, which is generally integrated into the roller mill, is moved by centrifugal force to the edge of the grinding bowl and to a blade ring surrounding the latter. The centrifugal force acting on the grinding material is in particular dependent on the diameter and speed of the grinding bowl.

The throughput of a roller mill is essentially determined by the available grinding surface, i.e. the number and size of the grinding rollers used and the grinding speed. This assumes an adequate supply of grinding material to each roller.

In principle, by a speed increase the throughput of a roller mill can be increased for the same, predetermined geometries and the same number of grinding rollers. Consequently a smaller roller mill can be used, which leads to lower costs.

However, a speed increase is simultaneously associated with a centrifugal force increase, which leads to the grinding bowl being partly or completely emptied in the area between two successive grinding rollers, So that the latter are no longer supplied with grinding material and the sought throughput increase cannot be achieved.

DE 36 42 814 A1 discloses a roller mill, which is provided with a retaining device between two grinding rollers for controlling the grinding material movement in the vicinity and on the grinding path. The retaining device is constructed as an arcuate baffle or deflector, which is fixed by means of holding devices to the roller mill housing and is adjustable as regards height and inclination.

A roller mill described in German patent 1 507 579 has facing a material feed and between two grinding rollers a deflector, through which it is intended to bring about a classification of the grinding material moved in the direction of the bowl edge. The shape and height of the deflector bring about a splitting up of the grinding material and a separate carrying off of the fine material flow and a retention of the coarse material on the grinding path.

The disadvantages of these known means are a relatively high friction between the grinding material and the deflector used as retaining device, which leads to an increased drive power requirement. As a result of the friction increased wear takes place to the deflectors and also the holding devices, which requires corresponding maintenance measures and hard surfacing of the deflectors and holding devices.

DE 39 21 986 C1 discloses a roller mill with precompacting or smoothing rollers. These precompacting or smoothing rollers are provided for equalization and levelling of the grinding bed and are in each case positioned upstream of a grinding roller. The smoothing or precompacting rollers are not constructed as retention devices for the grinding material moved outwards on the grinding path of the grinding bowl, but instead for venting and smoothing of the grinding material to be supplied to a grinding roller and in particular for eliminating a "bow wave" of an air-dust mixture. For obtaining this sought effect a precompacting or smoothing roller is positioned upstream of a grinding roller. However, this document does not disclose constructing and arranging the precompacting or smoothing rollers for retaining the grinding material on the grinding path. Thus, a retention effect of the smoothing or precompacting roller is only possible to a limited extent over the end face of such a roller.

The object of the invention is to provide a roller mill with a low-wear, and in particular efficient retaining device, which ensures an adequate grinding material supply to the grinding rollers, both at normal and increased grinding material speed, so that with reduced effort and expenditure a higher throughput is ensured.

According to the invention, this object is achieved by the features of claim 1. Appropriate and advantageous developments appear in the subclaims and description relative to the drawings.

The invention is based on the idea of using the particularly low friction of precompacting or smoothing rollers, which is clearly reduced compared with the known deflectors, for the sought and in particular efficient retention and to construct the precompacting or smoothing rollers as damming rolls with a predeterminable damming effect and positioning same between in each case two grinding rollers for a weir-like retention of the grinding material.

According to the invention, the roller mill has a rotary damming surface wall between two grinding rollers as a retaining device. On the grinding material moved outwards on the grinding path of the grinding bowl said rotary damming surface wall exerts a damming action. According to the invention, the damming action is brought about by a rotary damming surface wall with at least one damming roll, which is adjacent between two grinding rollers and which has at least one further damming surface besides a damming surface which is constructed on an inner end face facing the rotation axis of the grinding bowl. According to the invention, a damming roll has at least one damming ring on which is formed the further damming surface.

It is also possible to provide a damming roll with more than one further damming surface, in that several damming rings are located on a damming roll. The additional damming surfaces are then constructed on the insides of the damming rings, said damming rings appropriately projecting radially from the circumferential surface of a damming roll.

Appropriately the damming faces of the damming rings almost form a right angle with the rotation axis or the circumferential surface of the damming roll.

As a result of said further damming faces the retaining action of a damming roll is further increased. Grinding material, which as a result of the centrifugal action is moved from the grinding path in the direction of the damming rim of the grinding bowl, said movement taking place on a spiral path, is firstly blocked by the damming face of the inside end face of the damming roll and is subsequently retained on one or more further damming faces of the damming rings. Therefore the damming rings act as a weir or a blocking device and through the rotary construction of the damming wall an extremely low friction occurs.

In a particularly advantageous construction, beside an inner damming face, a damming roll has in the vicinity of the inner end face at least on the outer end face directed towards the roller mill casing wall, a damming ring, which forms an outer weir or an outer damming face.

The damming rings can appropriately be subsequently fitted to the damming rolls. A detachable arrangement permits an adaptation of the damming faces of the damming rings in accordance with the particular needs.

Appropriately the damming rings are made from a wear-resistant material and roll on the grinding bed with a circumferential surface with a relatively small, radial width.

In an alternative embodiment, a roller mill has as a retaining device a rotary damming surface wall formed from several, e.g. two damming rolls between in each case two grinding rollers. The several damming rolls are so positioned and dimensioned that their end faces form a rotary weir against the outflow of grinding material.

It is particularly advantageous that the rotary damming surface wall is formed by damming rolls rolling on the grinding bed and whose end face are arranged adjacent to one another and with a very small spacing with respect to the adjacent grinding roller.

In principle the damming rolls have no grinding action and are consequently generally exposed to little or no force, so that they do not "jump". Therefore, for a very good damming action, the friction is kept extremely low, which has an advantageous influence on the energy balance.

For the intended damming action or for the action of a weir against an outflow of the grinding material with a particularly low friction, it is appropriate to construct the damming rolls with a very low weight. The damming roll requires no defined additional force besides its own weight, because the damming roll performs no grinding. Appropriately a spring damping system is provided with which the damming roll is held on the grinding bed.

If there is a holding down force, e.g. by a spring damping system, a jumping of the damming rolls can be avoided.

It is avantageous to limit the free mobility of the damming rolls in the downwards direction towards the grinding path of the grinding bowl with the aid of a mechanism. A particularly simple limiting mechanism has a lever with a stop, a setscrew or a buffer.

In order to provide a very tight weir or a tight damming face wall, the damming rolls are so positioned that their rotation axes are under a leading angle or a following/trailing angle with respect to a radial arrangement.

As a function of the construction of the damming rolls, e.g. as a conical damming roll, cylindrical or also cambered damming roll, the damming rolls are so positioned that their extended rotation axes form an intersection with the rotation axis of the grinding bowl or with the longitudinal axis of the roller mill.

As a function of the mill geometry, the grinding material and the desired throughput, the damming rolls can be positioned in such a way that the damming faces of the inner end faces have a different radial spacing and/or a different inclination with respect to the rotation axis of the grinding bowl or to the longitudinal axis of the roller mill and overlap one another and/or the grinding rollers.

Alternatively to a purely rolling movement or with a rolling movement superimposed on a sliding movement, as a function of the arrangement of the damming rolls and the intersections of the rotation axes with the rotation axes of the grinding bowl above or below the grinding path plane, the damming roll can be driven in rotary manner in addition to the bowl. In addition, the circumferential surface areas of the damming roll formed between the damming rings can carry out a levelling or also a smoothing and precompression of the grinding bed, if the damming roll has a corresponding weight or is subject to additional force action.

The advantages of the roller mill according to the invention with the damming rolls as retaining devices are an extremely effective grinding material retention between the grinding rollers. As the grinding material is prevented from passing over the bowl rim and into the vicinity of the blade ring, a disadvantageous loading of the classifying air flow with inadequately comminuted grinding material is avoided. This relieves the mill circuit and a reduced delivery work is required, which improves the energy balance.

BRIEF DESCRIPTION OF THE DRAWINGS

The invention is described in greater detail hereinafter relative to the attached drawings wherein show.

DETAILED DESCRIPTION OF THE INVENTION

Figure 1:
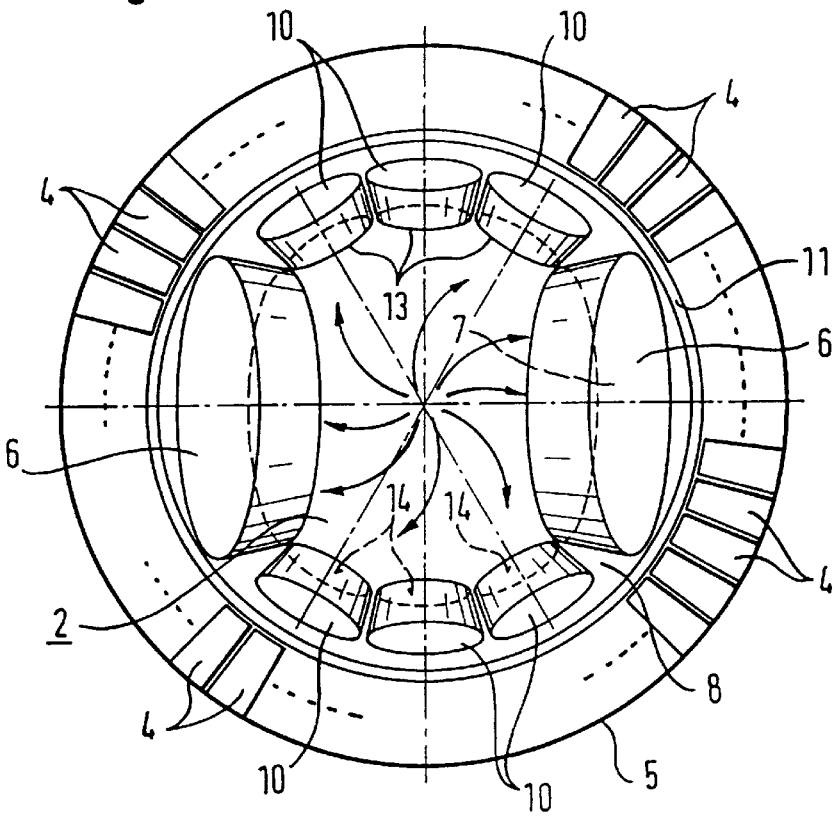
FIG. 1 A plan view of a grinding bowl of a roller mill with grinding rollers and with damming rolls as retention devices.

The diagrammatic representation of FIG. 1 shows a grinding bowl 2, which is rotated by means of a drive. The grinding material supplied from above or from the side to a grinding path 8 of the grinding bowl is comminuted between resiliently pressed grinding rollers 6 and the grinding path 8 of the bowl 2. The resilient pressing generally takes place by means of a rocking lever and a cooperating, not shown hydraulic cylinder means.

The grinding rollers 6 are generally driven solely by a frictional engagement with the grinding bed 7 located on the grinding path and have no separate drive. By means of a blade ring 4 (cf. also FIG. 2) by means of a supply duct a fluid, generally air is supplied. The fluid flowing in via the blade ring 4 conveys the grinding material mixture formed by fine and coarse material hurled towards as a result of the centrifugal force from the grinding path 8 and after over-rolling by the grinding rollers 6 so as to come into the vicinity of a not shown classifier. Fine material is removed from the roller mill, whereas the coarse material is supplied by means of a not shown coarse material outlet to the centre of the grinding bowl. Due to the centrifugal movement the coarse material, together with the fresh material passes onto the grinding path 8 and forms the grinding bed 7. The coarse material can at least partly be removed from the classifier or mill and supplied by means of feed mechanisms to an external circuit upstream of the grinding rollers 6.

In order to avoid that at a correspondingly high rotation speed of the grinding bowl 2 inadequately comminuted grinding material is conveyed between the grinding rollers 6, over the bowl rim 11 to the blade ring 4, in the form of retaining devices are provided damming rolls 10. Unlike the grinding rollers 6, the damming rolls 10 rest on the grinding bed 7 solely through their own weight and optionally through a spring damping system. The damming rolls 10 do not participate in the comminution of the grinding material. The main task of the damming rolls 10 is to "seal" the free space between the grinding rollers 6, so as to prevent inadequately comminuted grinding material from being hurled off the grinding path 8 and loading the mill circuit.

FIG. 1 shows a first variant of the damming rolls 10, which only have a damming face 12 on an inner end face 14. The total damming faces 12 in the vicinity of the inner end faces 14 form an almost tight damming face wall 13 or a weir, through which the grinding material is retained between the grinding rollers 6 and is supplied to the grinding path 8 of the following grinding roller 6. Only in the vicinity of the grinding rollers 6 and consequently following the comminution process can the grinding material be moved in the direction of the blade ring 4 and transported into the classifying chamber. FIG. 1 shows that the damming rolls 10 are arranged with a leading or following angle so as to bring about an efficient damming action for the grinding material moved on a spiral path.

Figure 2:
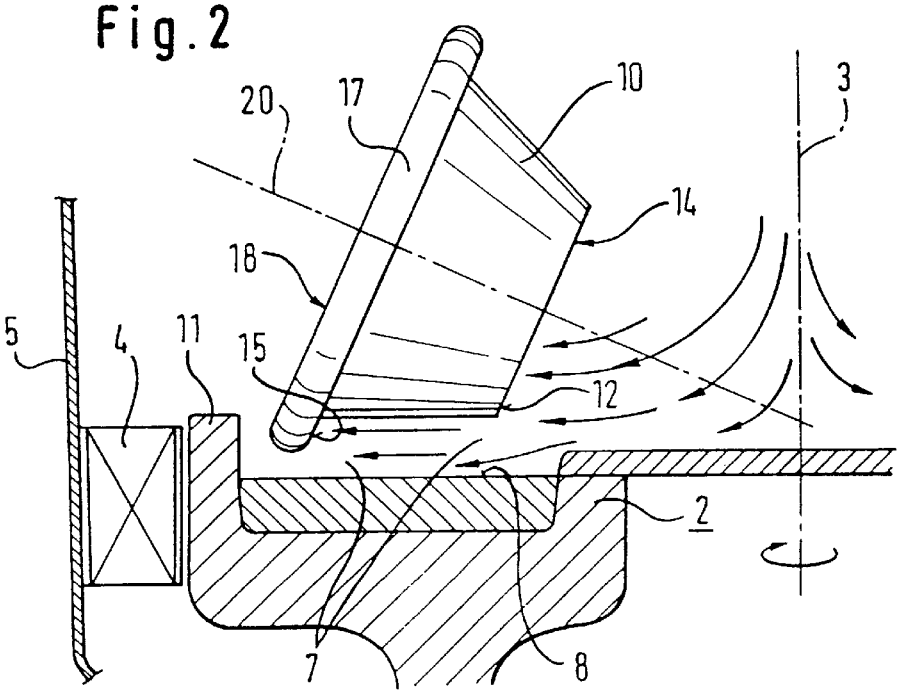
FIG. 2 A part sectional view of a roller mill in the vicinity of a damming roll rolling on a grinding bowl.

FIG. 2 shows a second, particularly effective damming roll 10 in a longitudinal section and its rotation axis 20 in extension intersects the rotation axis 3 of the bowl 2 level with the latter. The mounting and bearing of the damming roll 10, which is not shown, can take place in the same way as the mounting and bearing of the grinding rollers 6. If there are several damming rolls 10 and they have a particularly low weight compared with the grinding rollers, it is also possible to fix the rolls 10 to the casing. The damming roll 10 according to FIG. 2 has a damming face 12 on an inner end face 14, as well as a damming ring 17. This damming ring 17 runs in an outer end face 18 facing the roller mill casing wall 5 and is directed with a further damming face 15 towards the rotation axis 3 of the bowl. The same features are given the same reference numerals. The damming roll 10 according to FIG. 2 has a frustrum-shaped construction and as a result of the two damming faces, namely the inner face 12 and the outer face 15 constructed on the damming ring 17, a particularly good retaining action.

Figure 3:
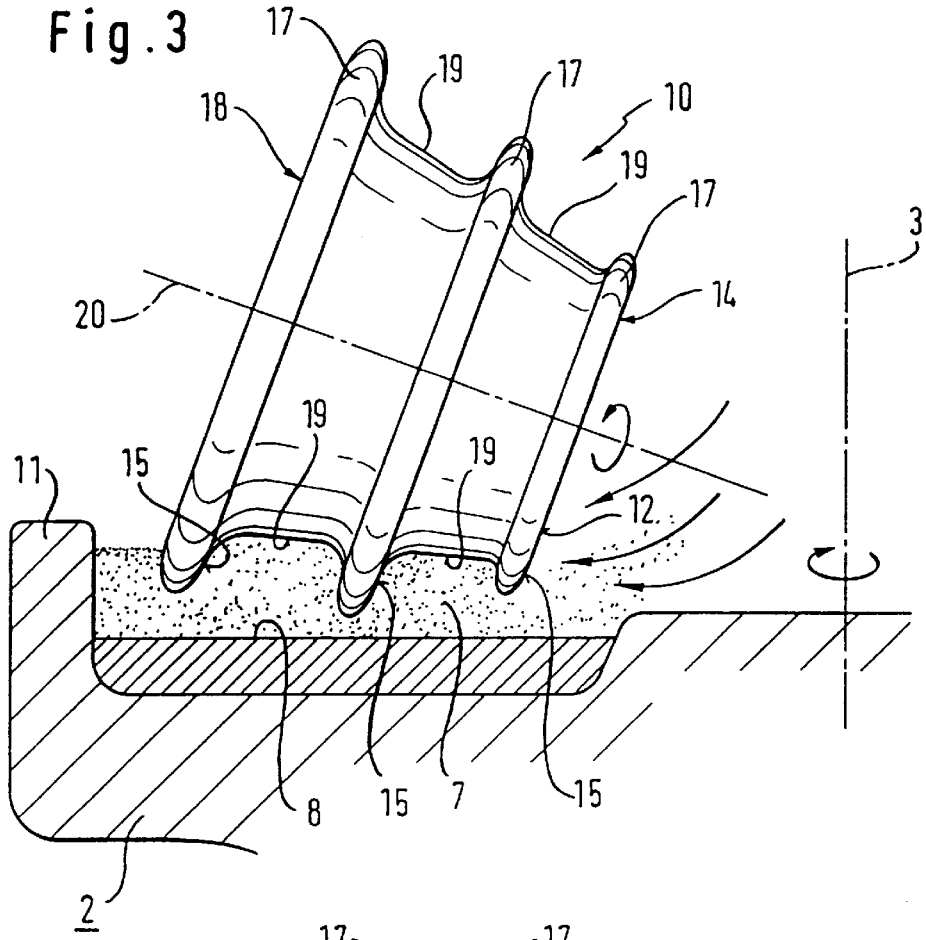
FIG. 3 A view of an alternative construction of a damming roll according to FIG. 2.

FIG. 3 shows another alternative damming roll 10. This conical damming roll 10 is constructed with three damming rings 17. It is also possible to removably fit them on the circumferential surface 19 of the damming roll 10. The associated damming faces 15 extend outwards radially from the circumferential surface 19 of the damming roll 10 and are in each case arranged in parallel. The damming faces 15 constructed on the damming rings 17 run approximately at right angles to the rotation axis 20 of the damming roll 10, so that grinding material moved up to the bowl rim 11 of the grinding bowl 2 is blocked and retained.

Advantageously the gap spacing between the grinding path 8 and the circumferential surfaces 19 of the damming rolls 10 is adjustable with the aid of a not shown device and is so dimensioned that the circumferential surfaces 19 contribute to a levelling or also a compression of the grinding bed. The damming rings 17 are made from a wear-resistant material. The damming faces 15 of the damming rings 17 can be planar, concave or convex.

Figure 4:
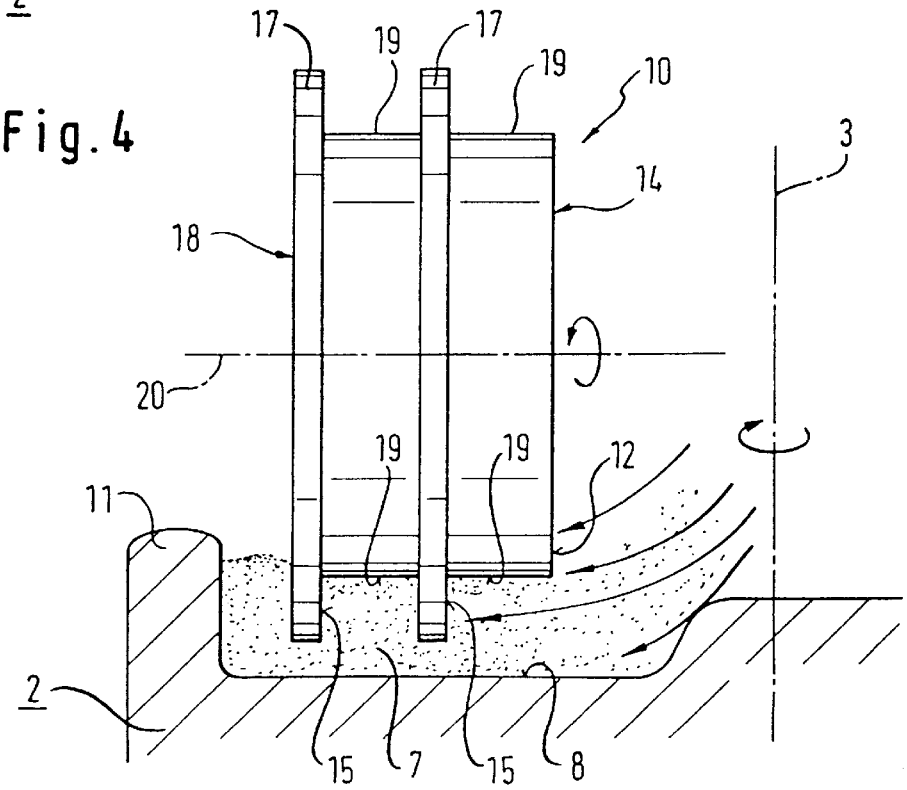
FIG. 4 A view of a cylindrical damming roll.

A cylindrical damming roll 10 according to FIG. 4 has a rotation axis 20 parallel to the grinding path 8. The damming roll 10 is provided with two damming rings 17, so that together with a damming face 12 on an inner end face 14 in all three damming areas 12, 15 are formed. Even in the case of a grinding bowl 2 rotating at high speed, in the case of a virtually adjacent arrangement of the damming rolls 10 and grinding rollers 16 an efficient retention and grinding are ensured, so that a roller mill equipped in this way has a high throughput with a reduced energy requirement, lower wear to retaining device and reduced maintenance costs.

What is claimed is:

1. Roller mill comprising:

a rotary grinding bowl with a virtually horizontal grinding path, stationary grinding rollers which roll on a grinding bed formed by grinding material on the virtually horizontal grinding path, and retaining devices, which influence movement of the grinding material, located between the grinding rollers, wherein each of said retaining devices is a rotary damming surface wall formed by at least one damming roll, wherein each damming roll rolls on the grinding bed between the grinding rollers and has a damming surface and at least one damming ring, wherein the damming surface is on an inner end face of each damming roll, and wherein a further damming surface is on each damming ring.

2. Roller mill according to claim 1, wherein each damming ring projects radially from a circumferential surface of each of the at least one damming roll.

3. Roller mill according to claim 1, wherein each damming ring is constructed on an outer end face of the damming roll facing a mill casing.

4. Roller mill according to claim 2, wherein at least two damming rings are provided, wherein circumferential surface areas are located between each of the damming rings, and wherein the circumferential surface areas level or compress retained grinding material.

5. Roller mill according to claim 4, wherein a mechanism is provided so that it is possible to adjust and/or limit a gap height between the circumferential surface areas and the grinding bed.

6. Roller mill according to claim 1, wherein each damming roll rests solely by its own weight on the grinding bed.

7. Roller mill according to claim 1, wherein each damming roll has a weight which is a fraction of the weight of the grinding rollers.

8. Roller mill according to claim 1, and further comprising a device by which each damming roll can be subjected to the action of a holding down force.

9. Roller mill according to claim 1, wherein each damming roll and the grinding rollers are so arranged that their extended rotation axes form an intersection with a rotation axis of the grinding bowl.

10. Roller mill according to claim 1, wherein each damming roll has a leading or following angle with respect to the grinding rollers, and wherein an extended rotation axis of each damming roll is located outside a rotation axis of the grinding bowl.

11. Roller mill according to claim 1, wherein each damming ring is made from wear-resistant material.

12. Roller mill according to claim 1, wherein at least one of the damming surfaces is planar or curved.

13. Roller mill according to claim 1, wherein each damming ring is detachable and/or subsequently fitted.

14. Roller mill comprising:

a rotary grinding bowl with a virtually horizontal grinding path, stationary grinding rollers which roll on a grinding bed formed by grinding material on the virtually horizontal grinding path, and retaining devices, which influence movement of the grinding material, located between the grinding rollers, wherein each of said retaining devices is a rotary damming surface wall which is formed by at least two damming rolls, and wherein said at least two damming rolls have end faces forming damming surfaces, are virtually adjacent to one another, and are positioned with a minimum spacing with respect to the adjacent grinding rollers.

* * * * *